US007516945B2

(12) United States Patent
Alberson et al.

(10) Patent No.: US 7,516,945 B2
(45) Date of Patent: Apr. 14, 2009

(54) CABLE ANCHOR BRACKET

(75) Inventors: Dean C. Alberson, Bryan, TX (US); Roger P. Bligh, Bryan, TX (US); D. Lance Bullard, Jr., College Station, TX (US); C. Eugene Buth, Wellborn, TX (US); Hayes E. Ross, Jr., College Station, TX (US); Stephen L. Brown, Carrollton, TX (US)

(73) Assignees: The Texas A&M University System, College Station, TX (US); TRN Business Trust, Dallas, TX (US)

( * ) Notice: Subject to any disclaimer, the term of this patent is extended or adjusted under 35 U.S.C. 154(b) by 0 days.

(21) Appl. No.: 11/775,436

(22) Filed: Jul. 10, 2007

(65) Prior Publication Data

US 2008/0011992 A1 Jan. 17, 2008

Related U.S. Application Data

(63) Continuation of application No. 10/819,526, filed on Apr. 7, 2004, now Pat. No. 7,243,908.

(51) Int. Cl.
*E01F 15/04* (2006.01)

(52) U.S. Cl. ..... 256/13.1; 404/6; 404/10

(58) Field of Classification Search ..... 256/13.1; 404/6, 9, 10

See application file for complete search history.

(56) References Cited

U.S. PATENT DOCUMENTS

| | | | | |
|---|---|---|---|---|
| 4,583,716 | A | 4/1986 | Stephens et al. | |
| 4,928,928 | A | 5/1990 | Buth et al. | |
| 5,067,430 | A | 11/1991 | Ford | |
| 5,078,366 | A | 1/1992 | Sicking et al. | |
| 5,391,016 | A | 2/1995 | Ivey et al. | |
| 5,407,298 | A | 4/1995 | Sicking et al. | |
| 5,775,675 | A | 7/1998 | Sicking et al. | |
| 6,022,003 | A | 2/2000 | Sicking et al. | |
| 6,173,943 | B1 * | 1/2001 | Welch et al. | 256/13.1 |
| 6,220,575 | B1 | 4/2001 | Lindsay et al. | |
| 6,299,141 | B1 | 10/2001 | Lindsay et al. | |
| 6,783,116 | B2 | 8/2004 | Albritton | |
| 2002/0024043 | A1 | 2/2002 | Albritton | |
| 2003/0015695 | A1 | 1/2003 | Alberson et al. | |

FOREIGN PATENT DOCUMENTS

| | | | |
|---|---|---|---|
| EP | 0 924 348 | A2 | 6/1999 |

OTHER PUBLICATIONS

Notification of Transmittal of the International Search Report and the Written Opinion of the International Searching Authority of International application No. PCT/US2005/011266 filed Apr. 5, 2005 (12 pages), Jul. 14, 2005.

* cited by examiner

*Primary Examiner*—Michael P Ferguson
(74) *Attorney, Agent, or Firm*—Baker Botts L.L.P.

(57) ABSTRACT

According to one embodiment, a cable anchor system for an end terminal includes a cable anchor bracket configured to couple to a guardrail, in which the cable anchor bracket includes a flat plate having an aperture formed therein and a plurality of protrusions extending from a plane containing the aperture. The protrusions are configured to releasably engage the guardrail.

11 Claims, 4 Drawing Sheets

CABLE ANCHOR BRACKET

RELATED APPLICATIONS

This application is a continuation of U.S. application Ser. No. 10/819,526, filed Apr. 7, 2004, and entitled "CABLE ANCHOR BRACKETS," now U.S. Pat. No. 7,243,908.

TECHNICAL FIELD OF THE INVENTION

The present invention relates generally to guardrail systems and, more particularly, to a cable anchor system.

BACKGROUND OF THE INVENTION

Guardrail systems are widely used along heavily traveled roadways to enhance the safety of the roadway and adjacent roadside. For example, end terminals are utilized at the upstream end of guardrail systems to dissipate impact energy from head-on collisions of vehicles with the upstream end to prevent intense deceleration of the vehicles. In addition, guardrail systems are designed to contain and redirect vehicles that impact the guardrails predominantly from the side.

One element that is utilized in guardrail systems to address impacts along the side of the guardrail downstream from the end terminal is a tension cable that connects between the end terminal support post and the guardrail. The tension cable is designed to provide tension strength during side impacts and to breakaway during head-on impacts to avoid counteracting the benefits of the impact absorbing end terminal.

SUMMARY OF THE INVENTION

According to one embodiment, a cable anchor system for an end terminal includes a cable anchor bracket configured to couple to a guardrail, in which the cable anchor bracket includes a flat plate having an aperture formed therein and a plurality of protrusions extending from a plane containing the aperture. The protrusions are configured to releasably engage the guardrail.

Technical advantages of particular embodiments of the present invention include improved performance of the connection between the tension cable and the guardrail by improving the alignment between the tension cable and anchor bracket. This is facilitated by an improved cable anchor bracket that reduces the eccentricity of the alignment between the cable and the guardrail. The cable anchor bracket also reduces manufacturing cost.

Other technical advantages are readily apparent to one skilled in the art from the following figures, descriptions and claims. Moreover, while specific advantages have been enumerated above, various embodiments may include all, some or none of the enumerated advantages.

DETAILED DESCRIPTION OF THE INVENTION

Figure 1:
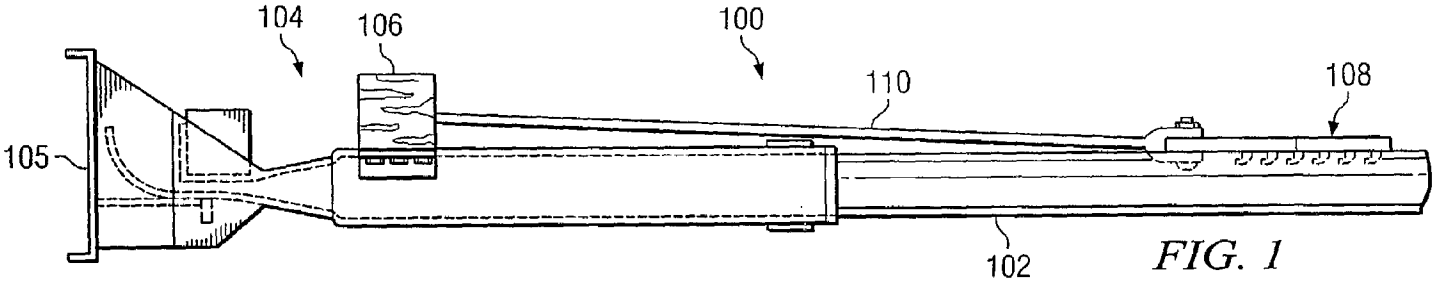
FIGS. 1 and 2 are plan and elevation views, respectively, of a guardrail system according to one embodiment of the present invention.
Figure 2:
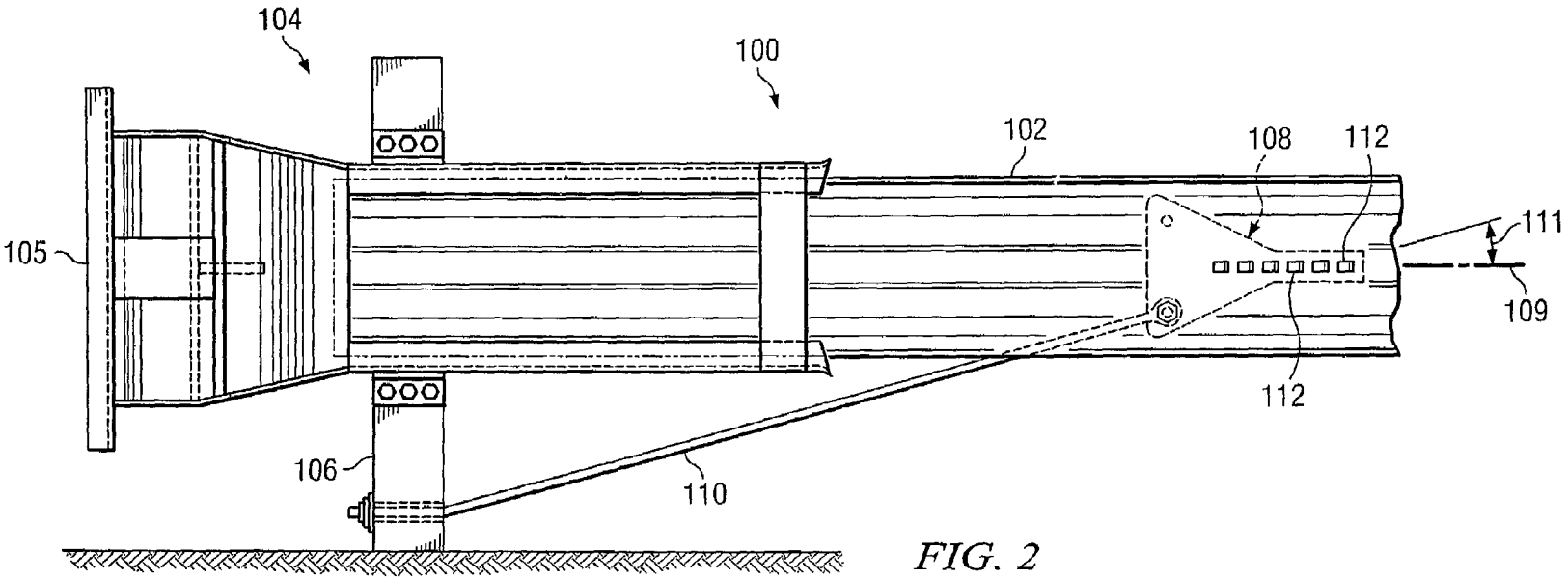

FIGS. 1 and 2 are plan and elevation views, respectively, of a guardrail system 100 according to one embodiment of the present invention. Guardrail system 100 may be installed adjacent a roadway to protect vehicles, drivers and passengers from various obstacles and hazards and prevent vehicles from leaving the roadway during a traffic accident or other hazardous condition. Guardrail systems incorporating aspects of the present invention may be used in median strips or shoulders of highways, roadways, or any suitable path that is likely to encounter vehicular traffic.

In the illustrated embodiment, guardrail system 100 includes a guardrail 102, an end terminal 104, a support post 106, a cable anchor bracket 108, and a cable 110.

Figure 5:
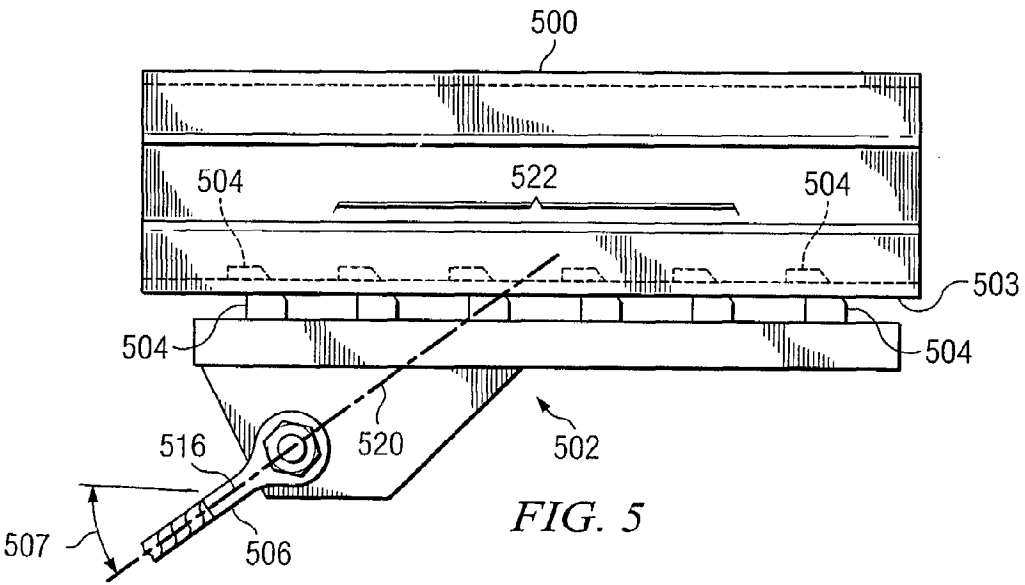
FIG. 5 is an elevation view of a guardrail system according to one embodiment of the present invention in which the guardrail is a box beam.

Guardrail 102 may be any suitable guardrail, such as a w-beam (illustrated in FIGS. 1 and 2) or a box beam (as illustrated in FIG. 5), having any suitable length. In the embodiment illustrated in FIGS. 1 and 2, an end of guardrail 102 is supported by end terminal 104, which may be any suitable end treatment. In the illustrated embodiment, end terminal 104 resembles a guardrail extruder terminal ("GET"), such as the ET-2000® and ET-PLUS® manufactured by Trinity Industries, Inc. An example description of a GET is described in U.S. Pat. No. 4,928,928 by Buth et al., which is herein incorporated by reference. The present invention contemplates any suitable end terminal that has a releasable anchor plate, such as a Sequential Kinking Guardrail Terminal System ("SKGTS"), an Anchor Assembly for Highway Guardrail End Terminal ("AAHGET"), a Guardrail Cutting Terminal ("GCT"), and a Box Beam Terminal.

Support post 106 functions to support end terminal 104 and/or guardrail 102. In the illustrated embodiment, support post 106 is a breakaway support post formed from a generally rectangular wood post; however, support post 106 may be any suitable support post formed from any suitable material and having any suitable shape.

Cable anchor bracket 108 may be coupled to guardrail 102 in any suitable manner; however, it is envisioned that cable anchor bracket 108 be releasably engaged with guardrail 102 so that cable anchor bracket 108 may be easily released from guardrail 102 during a head-on collision of a vehicle with an end 105 of end terminal 104 to avoid possible jamming of the movement of end terminal 104 and facilitate the safe and effective kinetic energy reduction during the head-on collision. In the illustrated embodiment, cable anchor bracket 108 is releasably coupled to guardrail 102 with a plurality of protrusions 112, as described in greater detail below in conjunction with FIGS. 3A and 3B.

According to the teachings of the present invention, cable anchor bracket 108 provides an improved alignment of cable 110 with guardrail 102 to provide improved performance of the connection between cable 110 and guardrail 102. As described in greater detail below, eccentricities with respect to cable 110 and the connection between cable anchor bracket 108 and guardrail 102 are reduced, thereby reducing moments resulting from a collision of a vehicle with the side of guardrail 102. A reduction in moments reduces the likelihood of "tear-out" of protrusions 112 and strengthens the connection between cable anchor bracket 108 and guardrail 102. The connection between cable anchor bracket 108 and guardrail 102 is described in greater detail below in conjunction with FIGS. 3A and 3B.

Cable 110 extends between support post 106 and cable anchor bracket 108. Cable 110 may be any suitable elongated element formed from any suitable material that provides tension to guardrail system 100 during a collision of a vehicle with a side of guardrail 102. A general function of cable 110 during a collision may be found in U.S. Pat. No. 4,928,928. In the illustrated embodiment, cable 110 forms an acute angle 111 with respect to a longitudinal axis 109 of guardrail 102. Acute angle 111 may be any suitable angle; however, in one embodiment, acute angle 111 is between approximately 15 and 25 degrees. One end of cable 110 couples to a lower portion of support post 106 in any suitable manner and the other end of cable 110 couples to cable anchor bracket 108 in any suitable manner. One example of coupling cable 110 to cable anchor bracket 108 is shown and described below in conjunction with FIGS. 3A and 3B.

Figure 3B:
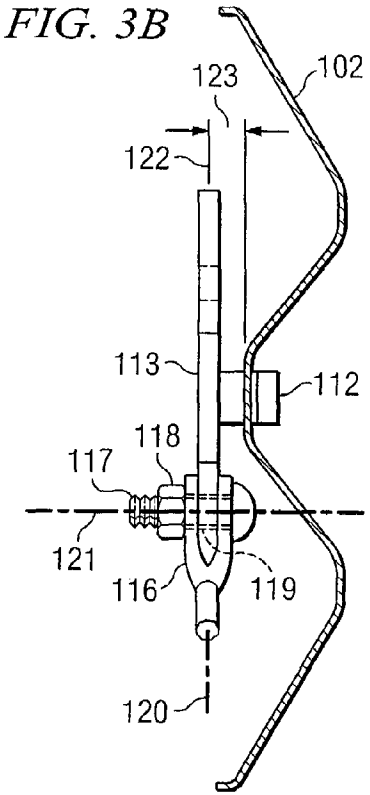
FIGS. 3A and 3B are perspective and elevation views, respectively, illustrating the coupling of a cable anchor bracket to a guardrail in accordance with one embodiment of the present invention.
Figure 3A:
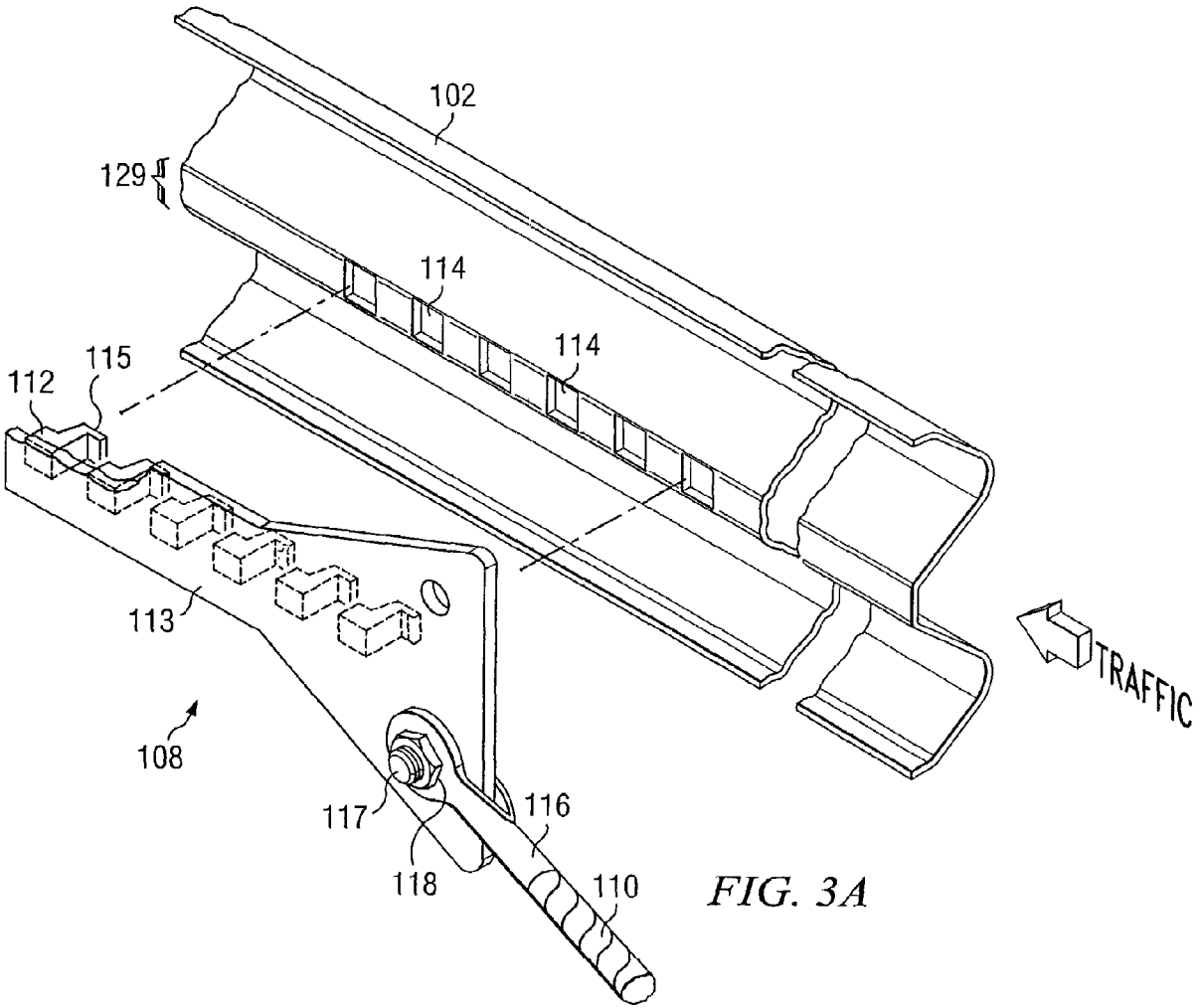

FIG. 3A is a perspective view and FIG. 3B is an elevation view illustrating the coupling of cable 110 to cable anchor bracket 108 and cable anchor bracket 108 to guardrail 102 according to one embodiment of the invention. In the illustrated embodiment, cable anchor bracket 108 is formed from a plate 113 having an aperture 119 formed therein and a plurality of protrusions 112 coupled to plate 113 and extending from a plane containing aperture 119. Plate 113 is preferably a single flat plate of structural steel with a thickness between approximately ¼ inches and ¾ inches. However, plate 113 may be formed from any suitable material having any suitable thickness.

Aperture 119 is utilized to couple cable 110 to cable anchor bracket 108 by any suitable method. In the illustrated embodiment, a shackle 116 is utilized along with a bolt 117 and a nut 118 to couple the end of cable 110 to plate 113. The use of shackle 116 allows a longitudinal axis 120 (FIG. 3B) of cable 110 to substantially align with a plane containing plate 113. For example, a plane running through the mid-thickness of plate 113, as denoted by reference number 122, substantially aligns with longitudinal axis 120. Depending on the location of support post 106 (see FIG. 1) and where cable 110 couples to support post 106, longitudinal axis 120 may form a slight angle with a plane containing plate 113. In addition, a longitudinal axis 121 of aperture 119 (FIG. 3B) is substantially perpendicular to longitudinal axis 120. This positioning of cable 110 with respect to plate 113 results in an eccentricity 123 with guardrail 102 that is less than eccentricities of prior cable anchor systems. The reduction in eccentricity reduces the moment on the connection of protrusions 112 with guardrail 102, thereby introducing less stress to the connection during a side impact collision. Thus, there is less chance for "tearing-out" of protrusions 112 during a side impact collision, which improves the performance of the connection.

In the illustrated embodiment, protrusions 112 cooperate with a plurality of apertures 114 formed in guardrail 102 in order to releasably couple cable anchor bracket 108 to guardrail 102. In the illustrated embodiment, this is facilitated by a plurality of tabs 115 associated with respective protrusions 112 that "hook on" respective apertures 114 formed in an attachment portion 129 of guardrail 102. The tautness of cable 110 after installation ensures the correct positioning of cable anchor bracket 108 in addition to keeping a snug fit of protrusions 112 with apertures 114. Any suitable number and arrangement of protrusions 112 may be utilized within the teachings of the present invention. The present invention also contemplates other suitable coupling methods for cable anchor bracket 108 that facilitate a releasable engagement.

Figure 4:
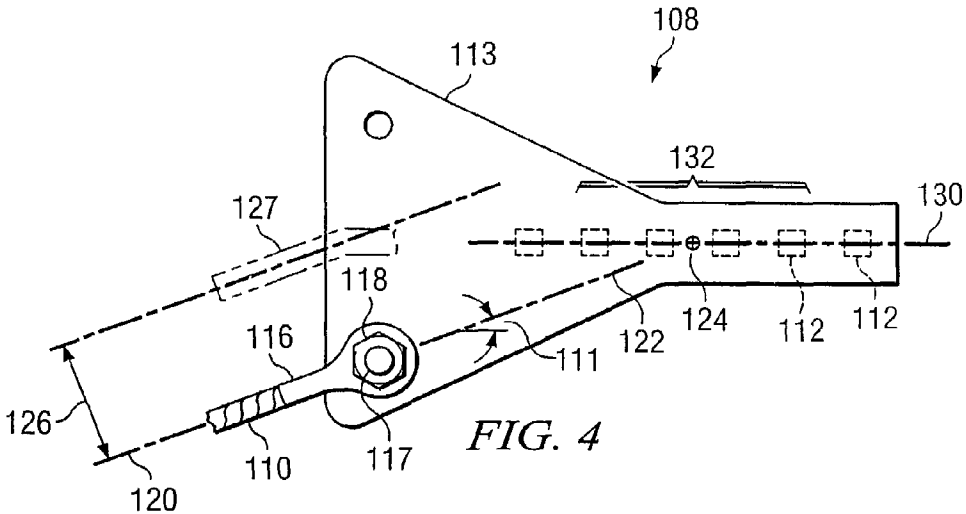
FIG. 4 is an elevation view of a cable anchor bracket according to one embodiment of the present invention.

FIG. 4 is an elevation view illustrating another advantage of cable anchor bracket 108 according to one embodiment of the invention. As described above in conjunction with FIGS. 1 and 2, cable 110 forms acute angle 111 with respect to the longitudinal axis 109 of guardrail 102. As illustrated by FIG. 4, this facilitates an extension 122 of longitudinal axis 120 of cable 110 intersecting a line 130 extending through the interior protrusions, as denoted by reference numeral 132, when viewed from a side elevation as in FIG. 4. In a particular embodiment, extension 122 may intersect a centroid 124 of all of the protrusions 112. Interior protrusions are defined by all of the protrusions 112 except the upstream-most protrusion(s) 112 and downstream-most protrusion(s) 112.

This positioning of cable 110 with respect to plate 113 substantially reduces or eliminates eccentricities, as denoted by eccentricity 126, that exists in prior cable anchor systems, thereby reducing an additional moment on the connection between cable anchor bracket 108 and guardrail 102. Eccentricity 126 results from the positioning of prior cables (denoted by reference numeral 127) of prior cable anchor systems. Eccentricity 126 causes additional stress on the connection between the cable anchor bracket and the guardrail of prior guardrail systems, thereby enhancing the possibility of failure of the connection and minimizing the effectiveness of a tension cable during a side impact with the guardrail.

Referring now to FIG. 5, an elevation view of guardrail system 100 according to another embodiment of the present invention is illustrated in which the guardrail is a box beam 500. In this embodiment, guardrail system 100 includes a cable anchor bracket 502 that couples to a bottom 503 of box beam 500. In the illustrated embodiment, box beam 500 has an "open" cross-section that resembles a C-section; however, box beam 500 may also have a "closed" cross-section.

Cable anchor bracket 502 may be coupled to bottom 503 of box beam 500 in any suitable manner; however, it is envisioned that cable anchor bracket 502 be releasably engaged with box beam 500 for reasons discussed above in conjunction with cable anchor bracket 108. In the illustrated embodiment, cable anchor bracket 502 is releasably coupled to box beam 500 with a plurality of protrusions 504, as described in greater detail below in conjunction with FIGS. 6A and 6B.

Figure 6A:
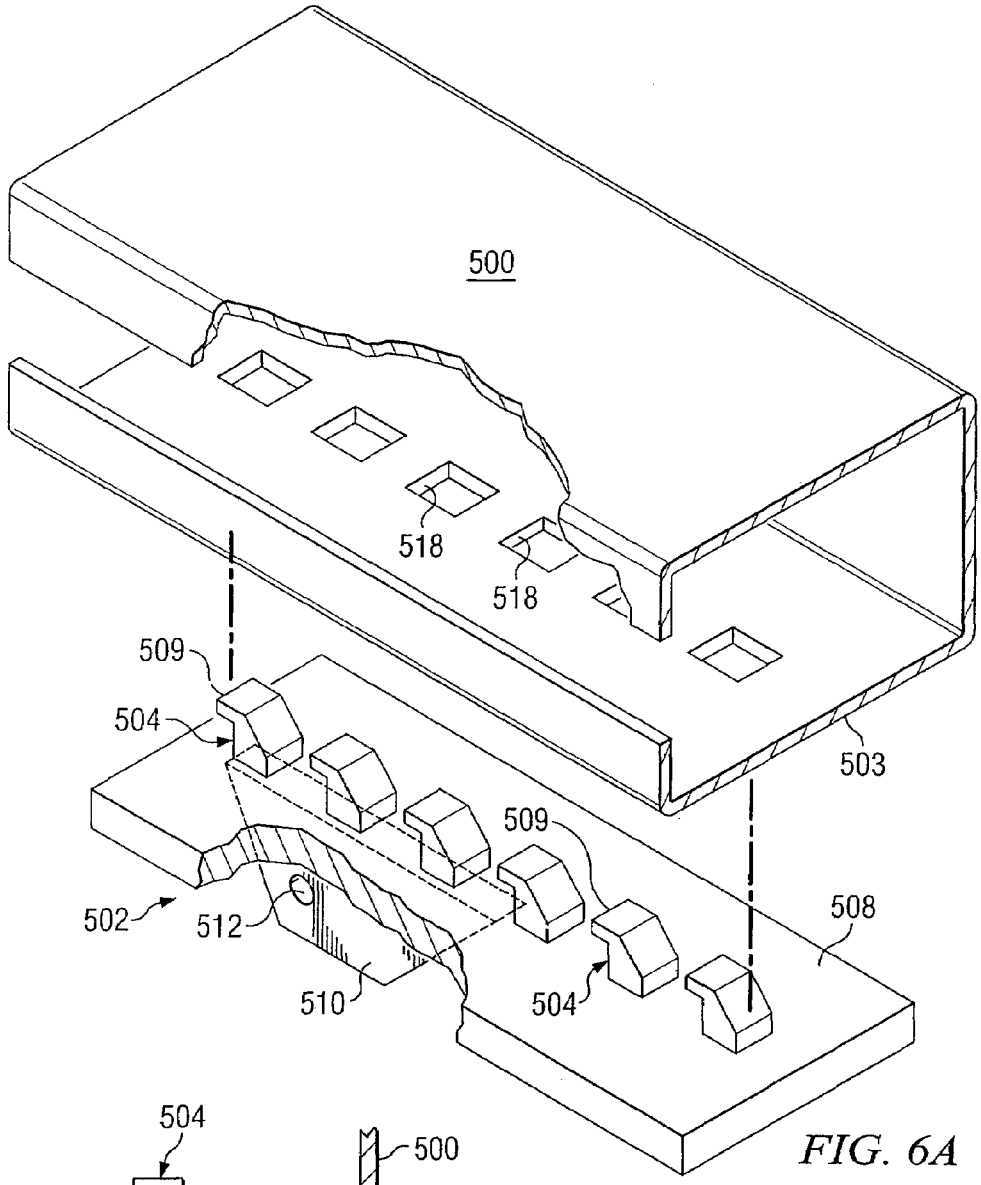
FIGS. 6A and 6B are perspective and elevation views, respectively, illustrating the coupling of a cable anchor bracket to a box beam in accordance with one embodiment of the present invention.
Figure 6B:
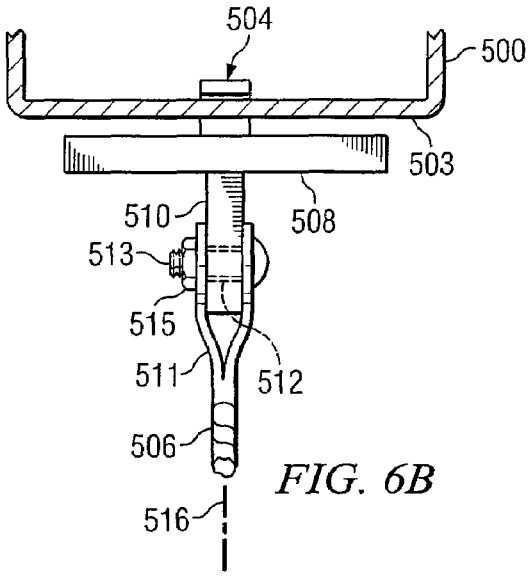

FIG. 6A is a perspective view and FIG. 6B is an elevation view illustrating the coupling of a cable 506 to cable anchor bracket 502 and cable anchor bracket 502 to box beam 500 according to one embodiment of the invention. In the illustrated embodiment, cable anchor bracket 502 is formed from a flange plate 508, a web plate 510 having an aperture 512 formed therein, and a plurality of protrusions 504 coupled to flange plate 508. Flange plate 508 and web plate 510 are preferably single flat plates of structural steel with a thickness between approximately ¼ inches and ¾ inches. However, flange plate 508 and web plate 510 may be formed from any suitable material having any suitable thickness. In the illustrated embodiment, web plate 510 extends substantially perpendicular to flange plate 508; however, web plate 510 may be angled with respect to flange plate 508 in some embodiments.

Aperture 512 is utilized to couple cable 506 to cable anchor bracket 502 by any suitable method. In the illustrated embodiment, a shackle 511 is utilized along with a bolt 513 and a nut 515 to couple the end of cable 506 to web plate 510. The use of shackle 511 allows a longitudinal axis 516 (FIG. 6B) of cable 506 to substantially align with web plate 510. Depending on the location of support post 106 (see FIG. 1) and where cable 506 couples to support post 106, longitudinal axis 516 may form a slight angle with web plate 510.

In the illustrated embodiment, protrusions 504 cooperate with a plurality of apertures 518 formed in bottom 503 of box beam 500 in order to releasably couple cable anchor bracket 502 to box beam 500. In the illustrated embodiment, this is facilitated by a plurality of tabs 509 associated with respective protrusions 504 that "hook on" respective apertures 518 formed in bottom 503 of box beam 500. The tautness of cable 506 after installation ensures the correct positioning of cable anchor bracket 502 in addition to keeping a snug fit of protrusions 504 with apertures 518. Any suitable number and arrangement of protrusions 504 may be utilized within the teachings of the present invention. The present invention also contemplates other suitable coupling methods for cable anchor bracket 502 that facilitate a releasable engagement.

Referring back to FIG. 5, cable 506 forms an acute angle 507 with respect to the longitudinal axis of box beam 500. This facilitates an extension 520 of longitudinal axis 516 of cable 506 intersecting a line extending through the interior protrusions, as denoted by reference numeral 522. In a particular embodiment, extension 520 may intersect a centroid of all of the protrusions 504.

Thus, an improved cable anchor bracket is disclosed by the present invention that improves performance of the connection of the cable anchor bracket with the guardrail by reducing eccentricities associated therewith. Reduced eccentricities result in reduced moments and reduced stress at the connection, thereby increasing the strength of the connection and ensuring that the anchor cable may perform its function in an efficient and safe manner.

Although the present invention is described by several embodiments, various changes and modifications may be suggested to one skilled in the art. The present invention intends to encompass such changes and modifications as they fall within the scope of the present appended claims.

What is claimed is:

1. A guardrail system, comprising:

a box beam;

an end terminal coupled to the box beam;

a support post for supporting the end terminal;

a cable anchor bracket coupled to the box beam;

a cable extending between the support post and the cable anchor bracket;

the cable anchor bracket comprising:

a flange plate having first and second opposing sides;

a plurality of protrusions coupled to and protruding in a longitudinally extending line from the first side of the flange plate, the plurality of protrusions releasably engaging a plurality of apertures formed in the box beam; and a web plate coupled to and protruding from the second side of the flange plate in alignment with the longitudinally extending line and having an aperture formed therein; and wherein the cable is coupled to the support post at a first end and coupled to the aperture of the web plate at a second end, the cable terminating at the aperture such that an extension of a longitudinal axis of the cable from the second end forms an acute angle with respect to a longitudinal axis of the box beam and the flange plate and approximately intersects a centroid of the protrusions along the longitudinally extending line.

2. The guardrail system of claim 1, further comprising a shackle coupling the second end of the cable to the aperture.

3. The guardrail system of claim 1, wherein the longitudinal axis of the cable substantially aligns with a plane containing the web plate.

4. The guardrail system of claim 1, wherein the acute angle is between approximately 15 and 25 degrees.

5. The guardrail system of claim 1, wherein a thickness of each of the flange and web plates is between approximately ¼ inches and ¾ inches.

6. The guardrail system of claim 1, wherein the end terminal comprises a box beam terminal.

7. A cable anchor system for an end terminal, comprising:

a box beam having a plurality of apertures formed in a bottom of the box beam;

a cable anchor bracket configured to couple to the bottom of the box beam, the cable anchor bracket comprising:

a flange plate having first and second opposing sides;

a plurality of protrusions coupled to and protruding in a longitudinally extending line from the first side of the flange plate, the plurality of protrusions releasably engaging the plurality of apertures formed in the bottom of the box beam;

a web plate coupled to and protruding substantially perpendicularly from the second side of the flange plate in alignment with the longitudinally extending line, the web plate having an aperture formed therein; and a cable having a first end configured to couple to a support post of the end terminal and a second end configured to couple to the aperture such that an extension of a longitudinal axis of the cable forms an acute angle with respect to a longitudinal axis of the box beam and the flange plate and intersects a line segment extending between interior ones of the protrusions along the longitudinally extending line when the cable is coupled to the aperture.

8. The cable anchor system of claim 7, further comprising a shackle configured to couple the cable to the aperture.

9. The cable anchor system of claim 7, wherein the longitudinal axis of the cable substantially aligns with a plane containing the web plate.

10. The cable anchor system of claim 7, wherein the acute angle is between approximately 15 and 25 degrees.

11. The cable anchor system of claim 7, wherein a thickness of each of the flange and web plates is between approximately ¼ inches and ¾ inches.

* * * * *